US007152888B2

(12) United States Patent
Kumar et al.

(10) Patent No.: US 7,152,888 B2
(45) Date of Patent: Dec. 26, 2006

(54) SYSTEM AND METHOD FOR IMPROVED DETECTION OF LOCOMOTIVE FRICTION MODIFYING SYSTEM COMPONENT HEALTH AND FUNCTIONALITY

(75) Inventors: Ajith K. Kumar, Erie, PA (US); Bret D. Worden, Union City, PA (US)

(73) Assignee: General Electric Company, Schenectady, NY (US)

( * ) Notice: Subject to any disclaimer, the term of this patent is extended or adjusted under 35 U.S.C. 154(b) by 354 days.

(21) Appl. No.: 10/606,723

(22) Filed: Jun. 26, 2003

(65) Prior Publication Data

US 2004/0060375 A1 Apr. 1, 2004

Related U.S. Application Data

(60) Provisional application No. 60/391,743, filed on Jun. 26, 2002.

(51) Int. Cl.
*B60B 39/00* (2006.01)
*B61F 19/00* (2006.01)

(52) U.S. Cl. ..... 291/3; 104/279

(58) Field of Classification Search ..... 104/279, 104/280; 291/2, 3

See application file for complete search history.

(56) References Cited

U.S. PATENT DOCUMENTS 4,230,045 A 10/1980 Fearon
4,634,545 A 1/1987 Zaleski et al.
4,726,448 A 2/1988 Schroeder et al.
4,781,121 A 11/1988 Kumar et al.
4,915,856 A 4/1990 Jamison
4,930,600 A * 6/1990 Kumar et al. ..... 184/3.2
4,992,568 A 2/1991 Larock
5,060,335 A 10/1991 Webster
5,086,591 A 2/1992 Panetti
5,134,808 A 8/1992 Panetti
5,158,694 A 10/1992 Waynick
5,173,204 A 12/1992 Chiddick et al.
5,251,724 A 10/1993 Szatkowski et al.
5,358,072 A 10/1994 Szatkowski et al.
5,477,941 A * 12/1995 Kumar et al. ..... 184/3.2
5,492,642 A 2/1996 Mulvihill et al.
5,687,814 A 11/1997 Craig et al.
5,722,509 A 3/1998 Clinger
5,726,448 A 3/1998 Smith (Continued)

*Primary Examiner*—S. Joseph Morano
*Assistant Examiner*—Robert J. McCarry, Jr.
(74) *Attorney, Agent, or Firm*—Senniger Powers; Carlos Hanze

(57) ABSTRACT

A system and method for assessing a health and functionality of a locomotive friction modifying system wherein the locomotive has a friction modifying applicator associated with a wheel of the locomotive for applying a friction modifying agent to a rail on which the wheel is traversing. The system and method comprise a sensor detecting a predetermined operational condition of the locomotive. The system and method also comprise a controller associated with the sensor and responsive to input from the sensor determining a per unit creep of an axle of the locomotive. The controller also determines a tractive effort of the axle of the locomotive and determines a friction modifying applicator state for the applicator associated with the axle. The controller further compares the determined per unit creep of the axle, the tractive effort of the axle and the state of the friction modifying applicator associated with the axle to a predetermined value indicative of the health and functionality of the locomotive friction modifying system. The controller provides an indication of the health and functionality of the locomotive friction modifying system.

20 Claims, 11 Drawing Sheets

U.S. PATENT DOCUMENTS 5,775,228 A * 7/1998 Lamba et al. ..... 105/73
5,896,947 A 4/1999 Kumar
5,919,295 A 7/1999 Lamba et al.
5,992,568 A 11/1999 Craig et al.
6,073,346 A 6/2000 Runkle
6,136,757 A 10/2000 Chiddick
6,170,610 B1 1/2001 Kumar
6,186,411 B1 2/2001 Sich
6,199,661 B1 3/2001 Kumar
6,254,696 B1 7/2001 Ueda et al.
6,276,281 B1 8/2001 Mesalic et al.

* cited by examiner

| Direction when Active | Fwd 102 & 104 | Rev 106 & 108 | | Fwd 110 & 112 | Rev 114 & 116 |
|---|---|---|---|---|---|
| Sand Functions | Lead Axle or Trainline or Auto | Trainline or Auto | | Trainline or Auto | Lead Axle or Trainline or Auto |

128

SYSTEM AND METHOD FOR IMPROVED DETECTION OF LOCOMOTIVE FRICTION MODIFYING SYSTEM COMPONENT HEALTH AND FUNCTIONALITY

CROSS REFERENCE TO RELATED APPLICATIONS

This application claims priority to U.S. Provisional Patent Application No. 60/391,743, filed on Jun. 26, 2002, the entire disclosure of which is incorporated herein by reference.

FIELD OF THE INVENTION

The invention relates generally to railroad friction modifying systems. More particularly, the invention relates to systems and methods for automatically detecting the health and functionality of a locomotive friction modifying system, as well as components thereof.

DESCRIPTION OF THE PRIOR ART

Locomotives used for heavy haul applications typically must produce high tractive efforts. The ability to produce these high tractive efforts depends on the available adhesion between the wheel and rail. Many rail conditions (especially wet), require an application of sand to improve the available adhesion. Therefore, locomotives typically have sandboxes on either end of the locomotives, and have nozzles to dispense this sand (both manually and automatically) to the rail on either side of the locomotive.

FIG. 1 illustrates a typical prior art locomotive having a sanding system for applying sand to the rails. Sand is stored in a short hood sandbox 118 or a long hood sandbox 120. The illustrated example includes eight sand nozzles 102-116. Locomotive 122 has two trucks, front truck 124 and rear truck 126. Additionally, front truck 124 has a front truck forward 30 and a front truck rear axle 132. Rear truck 126 has a rear truck front axle 134 and a rear truck rear axle 136. Front truck 124 has one nozzle in the front left 102, one nozzle in the front right 104, one nozzle in the rear left 106, and one nozzle in the rear right 108. The rear truck 126 similarly has one nozzle in the front left 110, one nozzle in the front right 112, one nozzle in the rear left 114, and one nozzle in the rear right 116. Chart 128 of FIG. 1 illustrates when each of the nozzles are active. For example, sand nozzle 114 is active in the reverse direction if "lead axle sand," "auto sand," or "trainline sand" is enabled. The sand function "lead axle" means sand is applied in front of the leading locomotive axle only and is enabled manually by the operator. The sand function "trainline" means sand is applied in front of both locomotives and is enabled manually by the operator. The sand function "automatic" means sand is applied in front of both locomotives automatically.

FIG. 2 illustrates a prior art schematic diagram of the sanding system 200 of FIG. 1. The system 200 includes a compressed air reservoir 202, one sandbox for each truck, front sandbox 204 and rear sandbox 206, one manual air valve for each truck, valve 208 for the front truck 124 and valve 210 for the rear truck 126. The system also includes two electrically controlled sand valves for each truck, valves 212 and 214 for the front truck and valves 216 and 218 for the rear truck. The system has two nozzles for each of these electrically controlled sand valves, nozzles 102 and 104 for the forward front truck valve 212, nozzles 106 and 108 for the reverse front truck valve 214, nozzles 110 and 112 for the forward rear truck valve 216, and nozzles 114 and 116 for the reverse rear truck valve 218. A locomotive control system 220 enables the appropriate sand valves based on the inputs from the operator or train lines, or when an adhesion control system determines that the rail conditions are poor and sanding will yield a higher tractive effort.

In the prior art, the sandboxes are periodically inspected to determine sand level. Based on the periodic inspection, the sandboxes are filled if needed. If sand runs out between inspections, however, there is no indication to the operator. Similarly, if a valve is not functioning or if a sand nozzle or any of the piping is blocked, sand delivery is adversely affected. Such problems can result in a locomotive not producing enough tractive effort and may cause train stall and undue delays for a whole railroad system. In the prior art, such problems are detected only at an inspection time. This is true for other prior art friction modifying systems as well.

BRIEF DESCRIPTION OF THE INVENTION

Therefore, there is a need for an improved system and method for automatically detecting the condition of a locomotive friction modifying system, as well as components thereof. Such a system and method monitors and assesses the effects of attempted friction modifying applications, for the purpose of friction enhancement/reduction control, so as to determine if a friction modifying agent actually was delivered to the desired wheel-rail interface.

One aspect of the invention provides a system for assessing a health and functionality of a locomotive friction modifying system wherein the locomotive has a friction modifying applicator associated with a wheel of the locomotive for applying a friction modifying agent to a rail on which the wheel is traversing. The system comprises a sensor for detecting a predetermined operational condition of the locomotive. The system also comprises a controller associated with the sensor and responsive to input from the sensor for determining a per unit creep of an axle of the locomotive. The controller also determines a tractive effort of the axle of the locomotive and determines a friction modifying applicator state for the applicator associated with the axle. The controller further compares the determined per unit creep of the axle, the tractive effort of the axle and the state of the friction modifying applicator associated with the axle to a predetermined value indicative of the health and functionality of the locomotive friction modifying system. The controller provides an indication of the health and functionality of the locomotive friction modifying system.

In another aspect of the invention, a method is provided for assessing health and functionality of a locomotive friction modifying system wherein the locomotive has a friction modifying applicator associated with a wheel supported on an axle of the locomotive for applying a friction modifying agent to the rail on which the wheel is traversing. The method comprises determining per unit creep of an axle of the locomotive, determining a tractive effort of the axle of the locomotive, and determining a friction modifying applicator state for the applicator associated with the axle. The method further comprises comparing the determined per unit creep of the axle, tractive effort of the axle, and state of the friction modifying applicator associated with the axle to a predetermined value indicative of the health and functionality of the locomotive friction modifying system. The method also provides an indication of the health and functionality of the locomotive friction modifying system.

DETAILED DESCRIPTION

Although the following detailed description is, for the most part, limited to sanding systems, it is to be understood that the systems and methods of the present invention apply equally well to other friction modifying agents such as, air, steam, water, lubricating fluid, or oil and includes agents that increase or decrease friction or remove another friction modifying agent.

Figure 1:
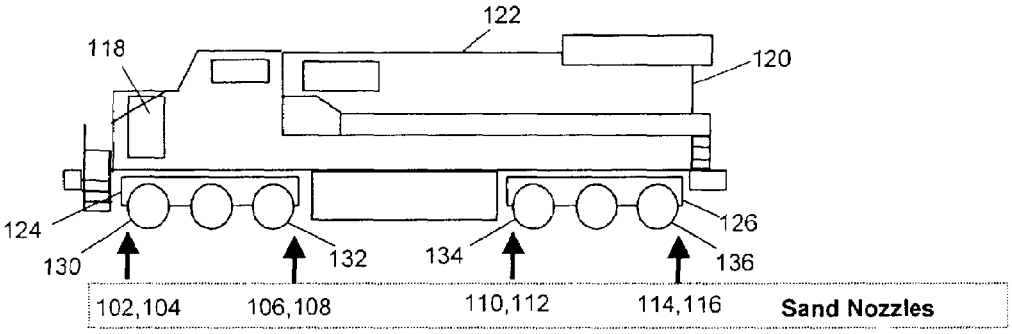
FIG. 1 PRIOR ART
FIG. 1 is a schematic illustration of a prior art locomotive having a sanding system.
Figure 2:
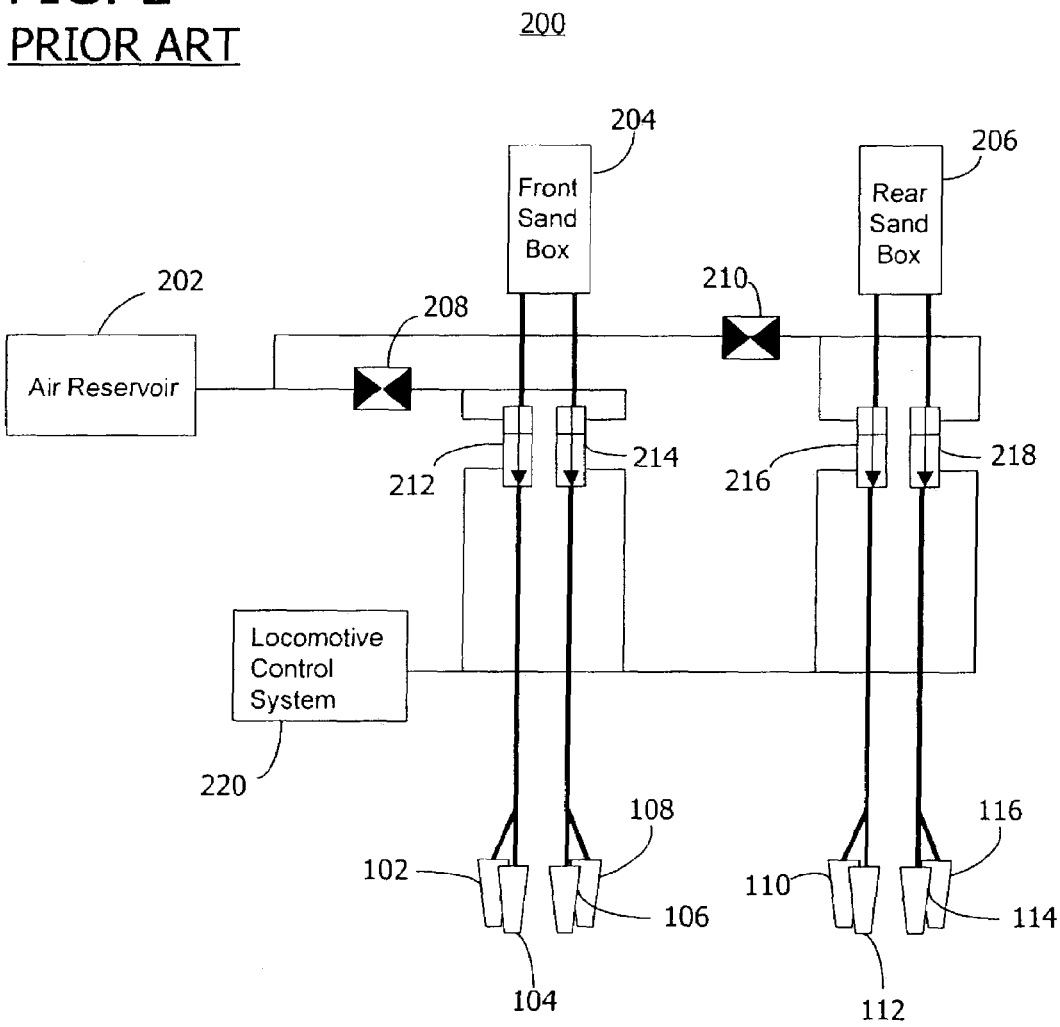
FIG. 2 PRIOR ART
FIG. 2 is a schematic further illustrating the sanding system of FIG. 1.
Figure 3:
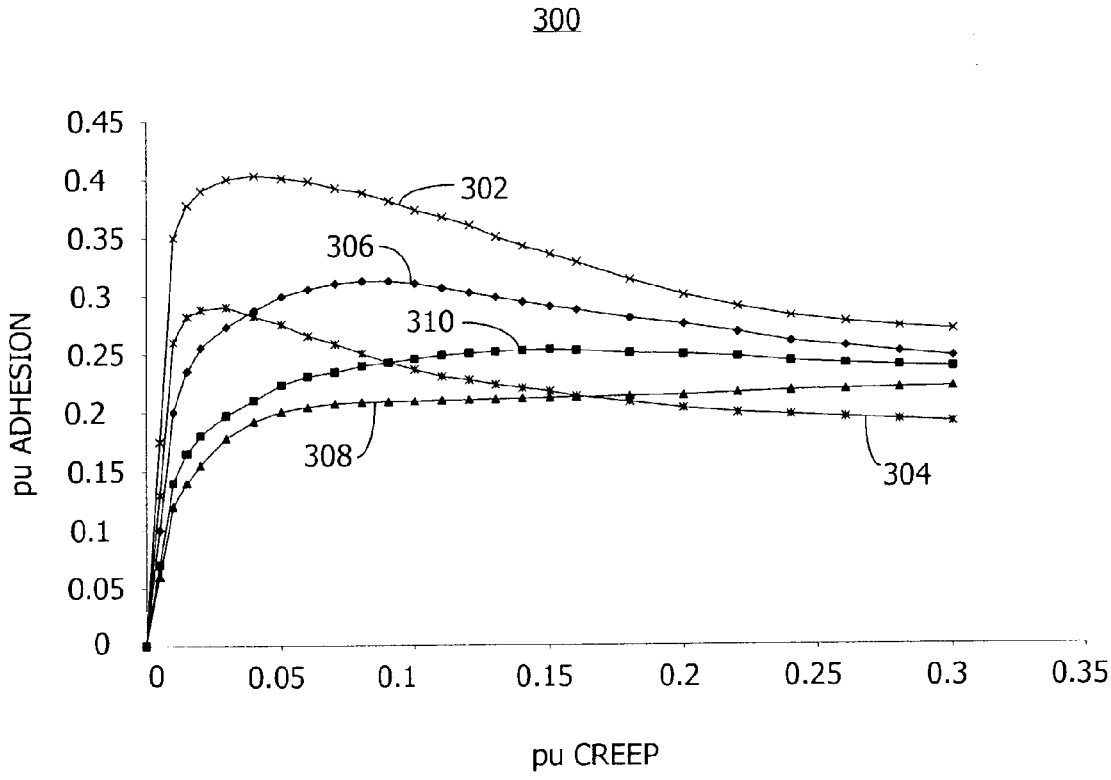
FIG. 3 illustrates exemplary adhesion versus creep curves for different rail conditions.

One way to assess the health of a locomotive sanding system is to recognize a change in friction that occurs when sand is introduced to the wheel/rail interface. FIG. 3 illustrates exemplary adhesion versus creep curves, identifying differences in friction or available adhesion for different potential rail conditions. As illustrated, curve 302 depicts the adhesion characteristics of dry sand that provides the highest level of adhesion for each level of per unit creep especially at per unit creep levels of less than 0.2. For per unit of creep levels of less than 0.05, wet sand as depicted by curve 304 provides a higher adhesion than a dry rail as shown by curve 306. However, at per unit creep levels greater than 0.05, wet sand curve 304 has less adhesion than the dry rail curve 306. For the situations where less adhesion is desirable, as is the case for connected railway cars or a locomotive rounding a curve in a track, oil as depicted by curve 308 provides the least amount of adhesion for per unit creep less than 0.1. Curve 310 illustrates the adhesion characteristics of water that also provides improved reduced friction as compared to a dry rail (curve 306) for per unit creep.

Figure 4:
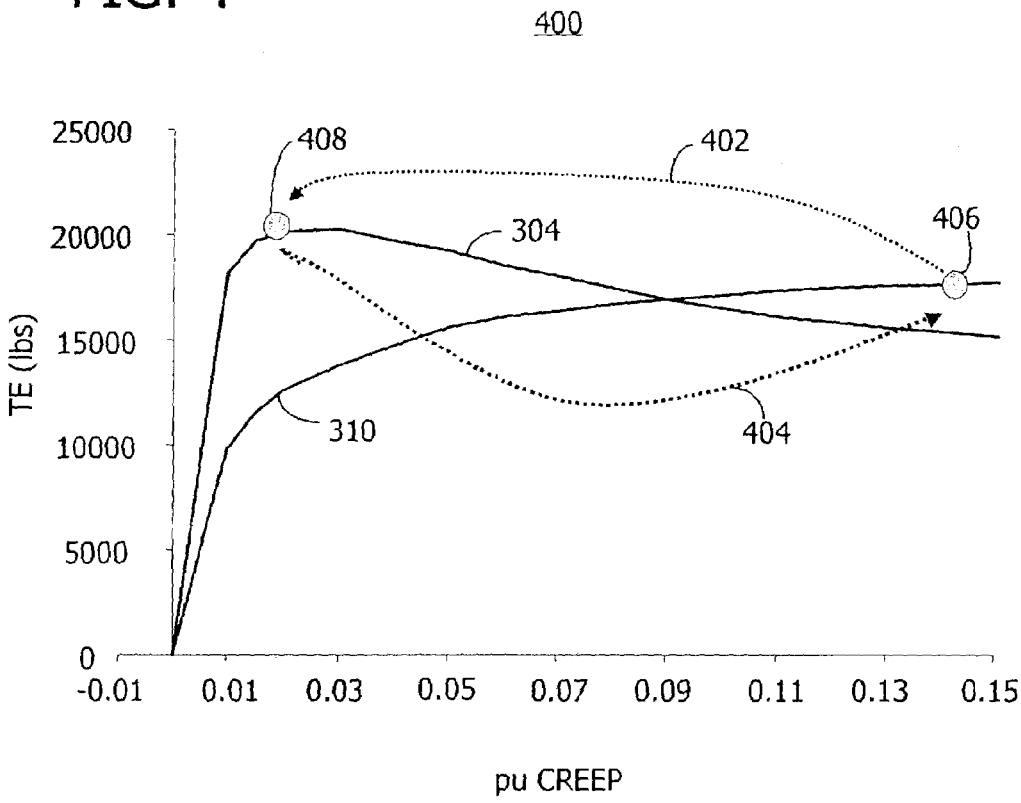
FIG. 4 illustrates exemplary friction/adhesion curves with and without sand applied in front of an axle during wet rail conditions.

FIG. 4 illustrates exemplary friction/adhesion curves that may exist with and without sand applied in front of an axle during wet rail conditions. Chart 400 illustrates two changes in the operating point of a wheel on a wet rail when sand is applied to the wet rail (curve 402) and when sand is removed from the rail (curve 404). For example, if sand is applied to a wet rail at point 406 on water curve 310, curve 402 illustrates that the creep decreases to point 408, a point on wet sand curve 304. Similarly, if water is applied to a rail operating at point 408 on the wet sand curve 304, the removal of the wet sand moves the creep from point 408 to point 406 on curve 310, thereby indicating a significant increase in creep. FIG. 4 also illustrates optimal adhesion control system performance—creep is controlled such that maximum tractive effort is attained (assuming that the operator is calling for more tractive effort than what can be sustained by the rail conditions). In this illustration, a locomotive is applying 17,000 pounds of tractive effort. However, at point 406 the rail is wet and the wheels are experiencing a per unit creep of more than 0.14. Sand is applied immediately prior to the advancing wheel of the locomotive. As a result, at point 408 tractive effort is increased to 20,000 pounds and per unit creep is reduced to less than 0.03. If the sand is later removed, the operating point returns from point 408 to the prior operating point 406. Creep is controlled such that maximum tractive effort is attained (assuming that the operator is calling for more tractive effort than what can be sustained by the rail conditions). Therefore, such a change can be observed by the adhesion control system only when the available adhesion at the wheel is utilized by the wheel and it typically happens at high tractive effort, low speed operating conditions. At other operating conditions the tractive effort versus creep characteristics change but not as dramatically.

Figure 5:
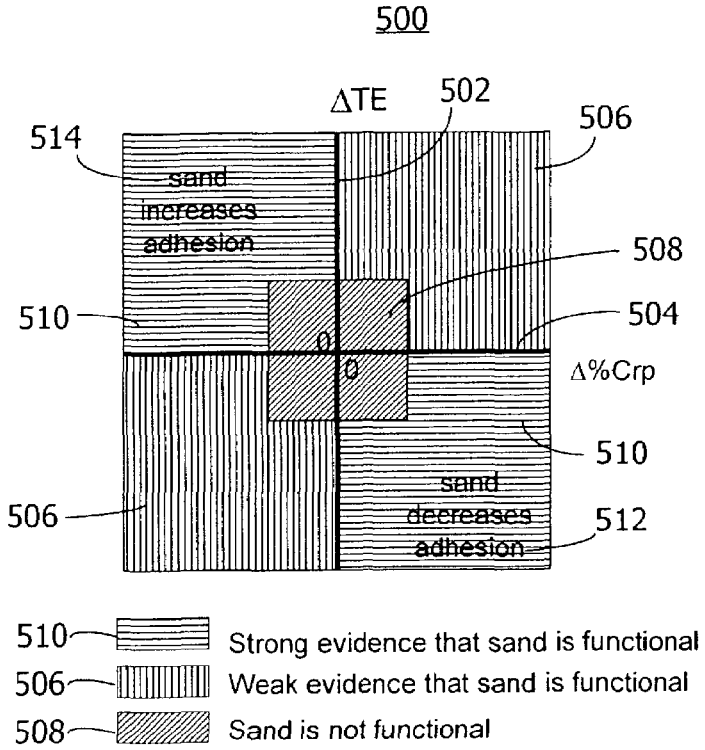
FIG. 5 is a graphic illustration of the effect of sand state change when the sand valve is moved from off to on at the wheel/rail interface and adhesion/creep changes.

In order to detect the application of sand to the rail, it is not required to fully understand the precise nature of the change in adhesion curves as previously shown. Any change in the friction/creep characteristics associated with sand state changes signifies the effect of sand. For example, if the rail conditions were such that upon application of sand the available adhesion or friction was to be reduced, this would also be detectable. FIG. 5 summarizes certain conclusions that may be drawn from the changes in tractive effort and creep that occur when sand is successfully applied to the wheel/rail interface. FIG. 5 illustrates the effect of sand state change when the sand valve is moved from off to on at the wheel/rail interface and adhesion/creep changes. The change in tractive effort is the vertical axis 502 and is charted as a function of the change in percentage creep the horizontal axis 504. As shown, where there is a positive change of tractive effort and positive change in creep or a negative change of tractive effort and negative change in creep, then there is weak evidence that sand is functional (weak evidence regions indicated as 506 and by the vertical lines). However, when there is a positive change in the tractive effort and a negative change in the creep (section 514), sand increases adhesion and there is strong evidence that the sand system is functional and delivering sand as required (strong evidence regions indicated by 514 and the horizontal lines). Similarly when there is a negative change in the tractive effort and a positive change in the creep (section 512) as when sand decreases adhesion, there is also strong evidence 510 that the sand system is functional. When the change in tractive effort and change in creep is small, whether each is positive and/or negative, this is evidence that the sand system is not functional as indicated by section 508 with the diagonal lines.

Figure 6:
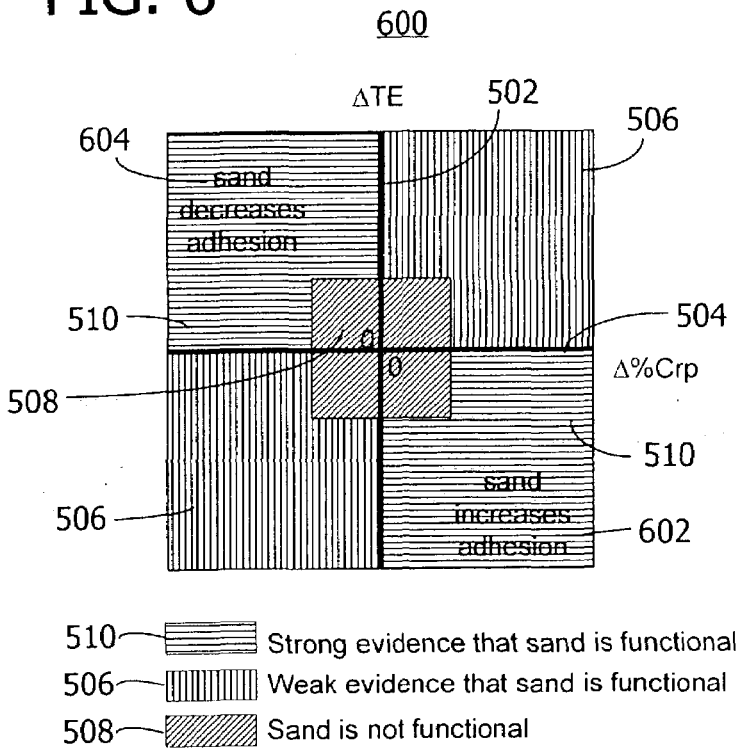
FIG. 6 is a graphic illustration of the effect of sand state change when the sand valve is moved from on to off at the wheel/rail interface and adhesion/creep changes.

Referring similarly to FIG. 6, the effect of sand state change when the sand valve is moved from on to off at the wheel/rail interface and adhesion/creep changes is illustrated. In this case, when there is a positive change in tractive effort and a negative change in creep, sand decreases adhesion (section 604) and there is strong evidence that the sand system is functional (indicated by 510). Similarly, when there is a negative change in tractive effort and a positive change in the creep, sand increases adhesion (section 602) and there is also strong evidence that the sand is functional (also indicated by 510). As with FIG. 5 above, when both the change in tractive effort and change in creep are either both positive or both negative, there is weak evidence 506 that the sand is functional. Additionally, when there is only a small change in both, whether positive or negative, then the sand system is not functional 508.

Analyzing the effect of adhesion/creep changes associated with manual, trainline, and/or automatic sand on each wheel, depending on the axle and direction of travel, provides an indication of the effectiveness of the sanding system. Such information can also be used to determine the state/health of the sandboxes, the sand valves, and/or the sand nozzles. Creep of an axle is the difference in speed of a wheel associated with the axle and the locomotive. Per unit creep is the ratio of creep to locomotive speed. Per unit creep of each axle "n" is calculated (sometimes identified herein as "creep_pu[n]"). The tractive effort of each axle (sometimes identified herein as "te[n]") is obtained from torque produced by each motor and the knowledge of wheel diameter and gear ratio. These te and creep calculations and changes associated with a sanding state change are used to determine the health of the sanding components of each truck, in each direction and for each sandbox.

Table 1, as provided at the end of the specification, provides a list of potential failure modes that correlates those modes to the sand nozzles affected by the failure modes. For example, if the front truck sandbox is closed (blocked), then nozzles 102, 104, 106, and 108 are affected.

Table 2, as provided at the end of the specification, identifies relationships between phenomena detected and the potential failure modes causing each detected phenomenon. For example, if axle 1 friction indicates no sand in the forward direction, then the reasons could be (a) the front truck manual air valve is closed, (b) the front truck forward sand solenoid valve is failed, or (c) the front truck sandbox is blocked.

Figure 7:
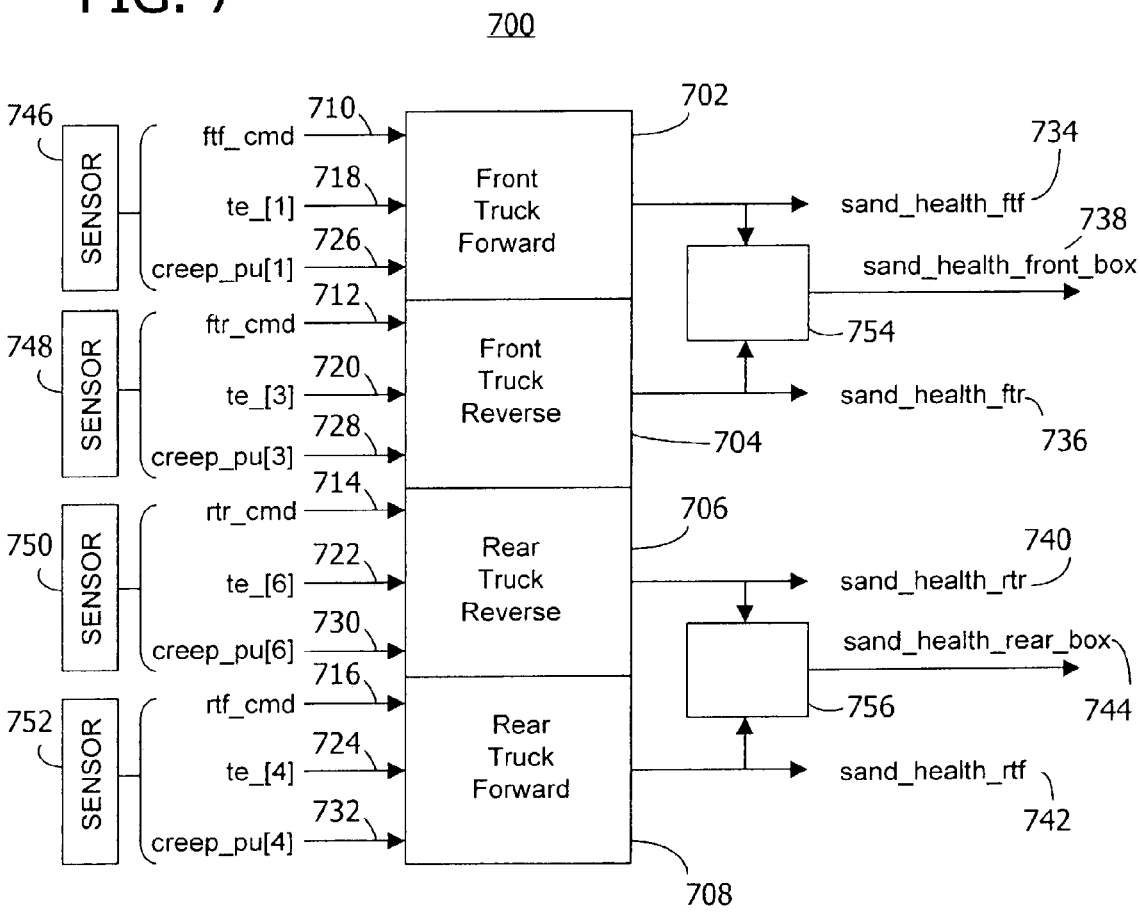
FIG. 7 is a relationship diagram illustrating relationships between (a) the tractive effort, (b) creep of axles (1, 3, 4, and 6), and (c) sand valve command states on the health of sanding (front truck forward, front truck reverse, rear truck reverse and rear truck forward) and the sandboxes (front and rear).

FIG. 7 is a relationship diagram illustrating relationships between (a) the tractive effort, (b) creep of axles (1, 3, 4, and 6 which correspond to axles 130, 132, 134, and 136, respectively), and (c) sand valve command states on the health of sanding (front truck forward, front truck reverse, rear truck reverse and rear truck forward) and the sandboxes (front and rear). Sensor 446 detects input to the front truck forward system 702. These inputs include the front truck forward command 710, the tractive effort of axle 1 (718), and the per unit creep of axle 1 (726). Sensor 748 collects inputs to axle 3 for the front truck reverse system 704 including the front truck reverse command 712, the tractive effort 720, the per unit creep 728 for axle 3. Sensor 750 detects input to the rear truck forward system 706. These inputs include the rear truck forward reverse 714, the tractive effort of axle 6 (722), and the per unit creep of axle 6 (730). Sensor 752 collects inputs to axle 4 for the rear truck forward system 708 including the rear truck forward command 716, the tractive effort 724, and the per unit creep 732 for axle 4.

The front truck forward system 702 analyzes the data and outputs the sand health for the front truck forward (FTF) 734. The front truck reverse (FTR) system 704 analyzes the data and outputs the sand health for the front truck reverse 736. Both of these are provided inputs to the front sandbox health determination system 754 that outputs the sand health front box 738. Similarly, the rear truck reverse (RTR) system 706 analyzes the data and outputs the sand health for the rear truck reverse 740. The rear truck forward (RTF) system 708 analyzes the data and outputs the sand health for the rear truck forward 742. Both of these are provided inputs to the rear sandbox health determination system 756 that outputs the sand health rear box 744.

In FIG. 7, only an axle immediately following the sand nozzle is used since that axle experiences the greatest change, even though other axles may also experience the effect of sanding. A slight variation of this method would be the use of information from multiple axles and aggregate the information such as by using the average or mean of the information from multiple axles. FIG. 7 further assumes that a single nozzle failure (e.g., due to misalignment, blockage, etc.) is detected by the axle 1 torsional vibration.

Figure 8:
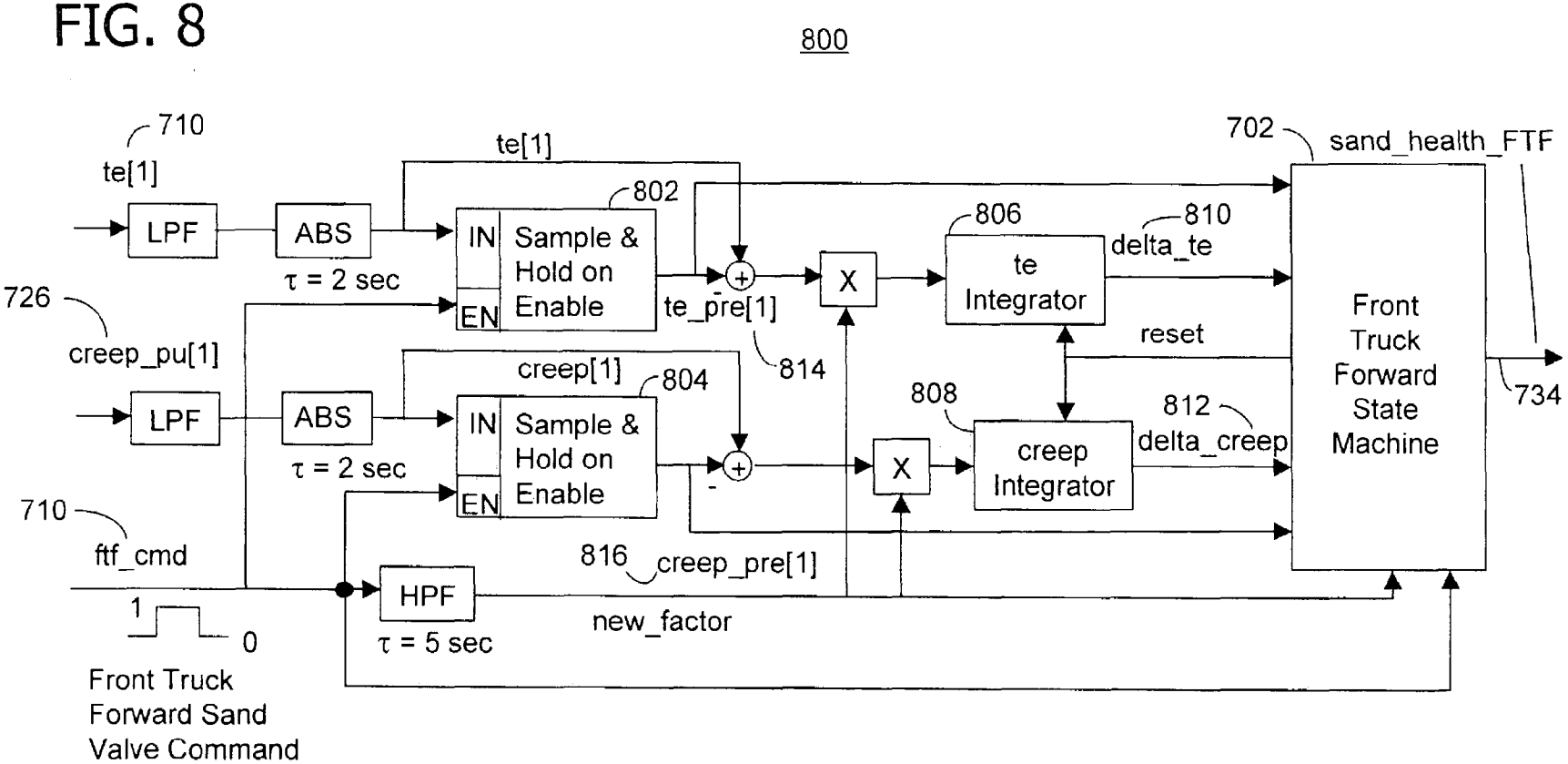
FIG. 8 is a logic diagram illustrating a sand health determination at an exemplary axle location (axle 1).

FIG. 8 is a logic diagram 800 illustrating a sand health determination at one exemplary axle nozzle location for the first axle, e.g., axle 1 of the front truck forward (FTF). The inputs are the tractive effort of the first axle 710, per unit creep of the first axle 726, and the command to the front truck forward sander 710. The creep 726 and tractive effort 710 are filtered by a low pass filter (LPF) and the absolute value (ABS) is sampled synchronously with the sander command changes by sample and hold systems 804 and 802, respectively. When the process is enabled (EN), the outputs include the previous creep values creep pre 816 and the previous tractive effort_pre 814 are integrated by creep integrator 808 and tractive effort integrator 806 to produce the delta creep 812 and the delta tractive effort 810, e.g., the change of creep and tractive effort. These changes are input into the front truck forward state machine 702. The front truck forward state machine 702 also receives the front truck forward command and new factor and generates the sand health front truck forward 734. Similar processes are used for each of the other axle systems. The logic used here is shown and described for a six axle locomotive but it is contemplated that four or eight axle locomotives can similarly be controlled.

Figure 9:
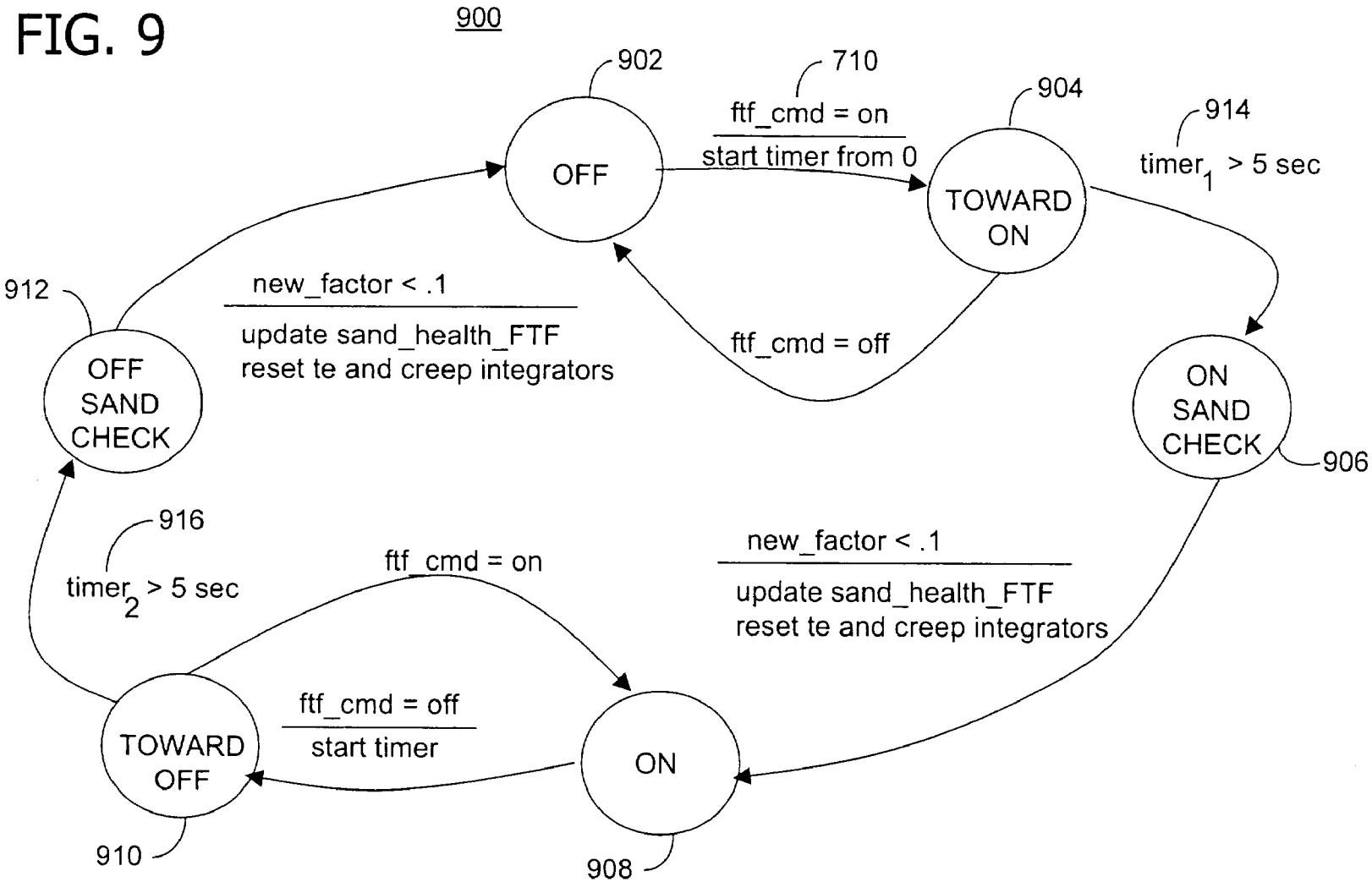
FIG. 9 is a control state diagram for determining the health of a nozzle.
Figure 10:
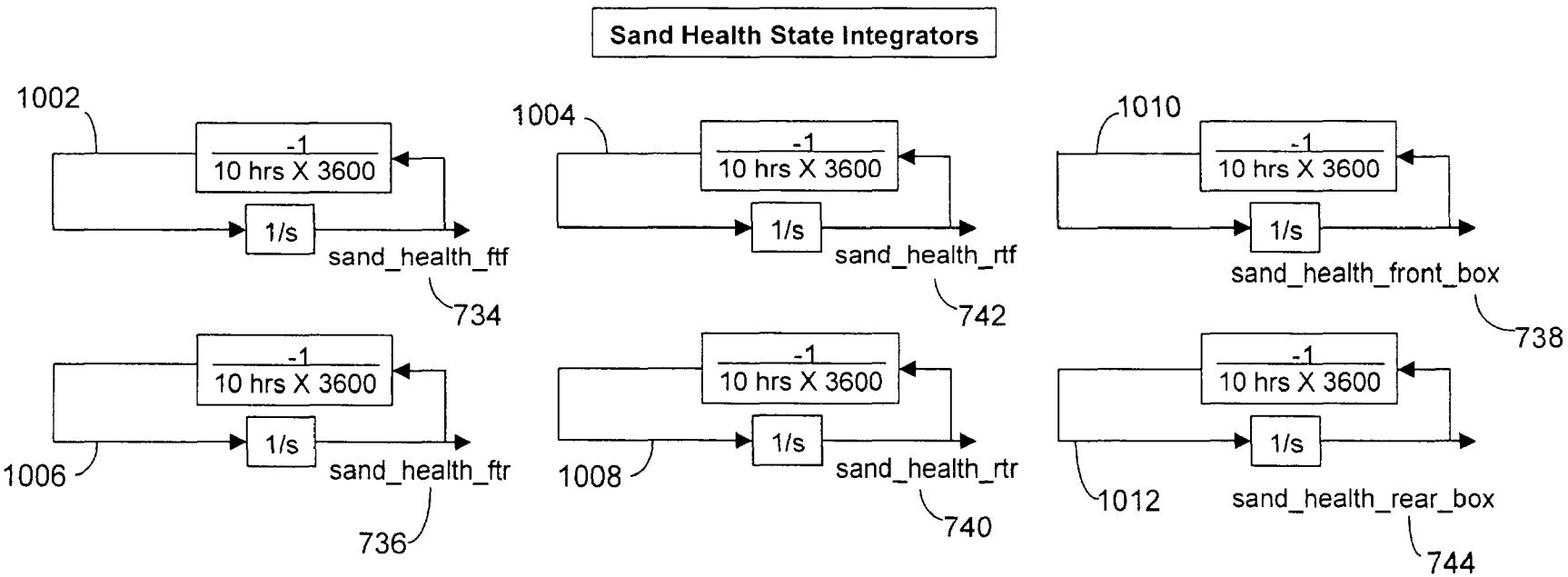
FIG. 10 illustrates six sand health state integrators.

FIG. 9 is a control state diagram 900 illustrating a determination of the health of one of the nozzle locations. The illustrated example depicts the front truck in the forward direction, i.e., first axle sanding system. These state machines control a set of sand health state integrators, which are illustrated in FIG. 10. The system starts in the OFF state 902. When the front truck forward 710 is commanded from OFF to ON, the system changes state to the TOWARD ON 904. Once time exceeds timer 1 (914) which has a predetermined time such as 5 seconds, then the system changes state to ON SAND CHECK 906. Of course if the front truck forward command 710 is changed to the off state before the timer exceeds 5 seconds, the system returns to the OFF state 902. The ON SAND CHECK 906 changes to ON state 908 when the new factor is less than 0.1 and the update sand health front truck forward 734 and the tractive effort and creep integrators as reset. When the front truck forward command 710 is changed to off and second timer 916 is started and the system changes to the TOWARD OFF 910 state. If the front truck forward command 710 is changed to on, the state changes back to the ON state 908. If the time interval exceeds the predetermined value of the second timer 916, then the system changes to OFF SAND CHECK state 912. In the OFF SAND CHECK state 912 new factor is less than 0.1, the sand health front truck forward is updated and the tractive effort and creep integrators are reset and the state changes to the OFF state 902. Similar state change diagrams apply to each of the other sand health systems.

Six sand health state integrators are shown in FIG. 10. They are sand health front truck forward 734 integrator 1002, sand health front truck reverse 736 integrator 1006, sand health rear truck forward 742 integrator 1004, sand health rear truck reverse 740 integrator 1008, sand health front box 738 integrator 1010, and sand health rear box 744 integrator 1012. The appropriate integrators are enabled based on the sand health determination state diagram as illustrated in FIG. 9. These integrators are limited to values of +/−1. A "+1" value indicates that the health of the associated sanding system (for example the forward sander in the front truck) is completely healthy or functional. A "−1" value indicates that the sanding system is not functioning. A health state value of "0" indicates that there has not been enough information to determine the health of the system. Preferably, the integrators are always enabled and are incremented or decremented by the various state machines. As time progresses with no sand state changes, the health indicators slowly return to a value of 0 at a predetermined time constant (for example 10 hours). This is done so that if no sand state changes have happened recently, it is possible for the health of the sanding system to change (e.g., due to freezing, repairing, an addition of sand, and so on), and under this condition the health returns to an indication corresponding to unknown. If at any time the health has fallen below a predetermined level, the appropriate personnel (e.g., an operator, a designated maintainer, remote monitoring equipment or remote monitoring personnel) are preferably informed so that they can take appropriate action.

Figure 11:
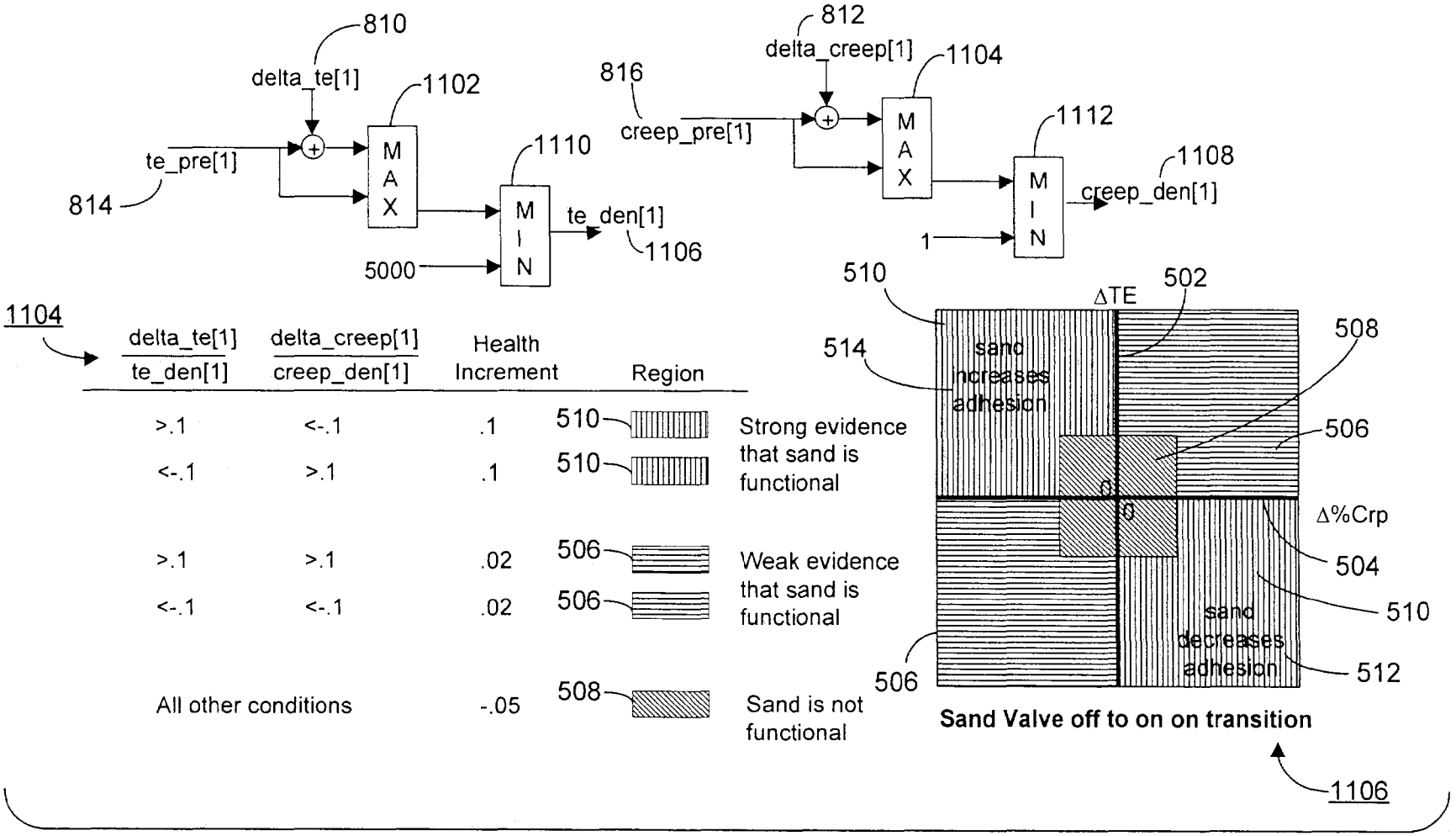
FIG. 11 illustrates sand health update logic for an OFF to ON transition of the sanding system command.

FIG. 11 illustrates sand health update logic for an OFF to ON transition of the sanding system command. The thresholds and health increments are shown for exemplary purposes only. The sand health update logic uses percentage change in tractive effort and percentage change in creep when the sand logic command changes from OFF to ON. The logic uses a tractive effort change ratio and creep change ratio. The tractive effort change ratio is a ratio of the tractive effort change to the maximum value of tractive effort obtained around the command transition. An absolute minimum value of tractive effort is assumed to avoid a large per unit change calculation error caused by measurement errors. The previous tractive effort 814 and input along with the change in tractive effort 810 and compared with the maximum value at 1002, which is shown for illustrative purposes as the value 5000. This is compared with the minimum at 1110 and the current value of the tractive effort 1106 is output. Similarly, the ratio of creep change around the command transition is also calculated. The previous creep value 816 is input along with the change in creep 812 to a maximum determination function 1104. This determination is input to the minimum value function 1112 and compared to a minimum value, shown in FIG. 11 as 0.1 for illustrative purposes. A current value of the creep 1108 is determined. The current values of the tractive effort 1106 and creep 1108 are compared to the changes in tractive effort and creep in table 1104 where a determination is made regarding the functional effectiveness of the sand system. As shown in FIG. 10, the ratio changes can be shown as regions in chart 1106 (Similar to previous FIG. 5). Each region can be classified as (a) strong evidence that the sand system is functional 510, (b) weak evidence that the sand system is functional 506, or (c) evidence that the sand system is determined to be nonfunctional 508.

Figure 12:
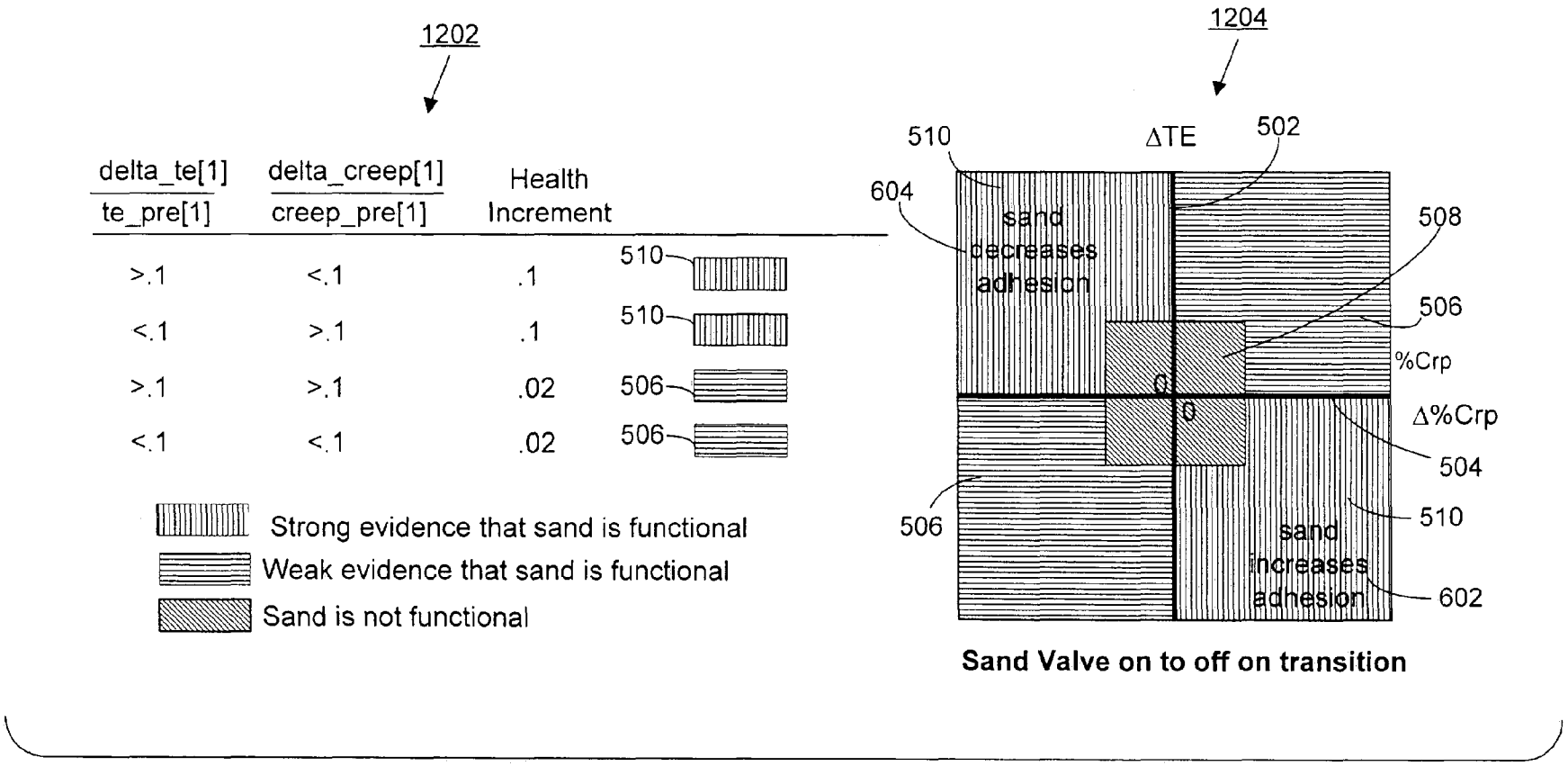
FIG. 12 illustrates sand health update logic for an ON to OFF transition of the sanding system command.

Similarly, FIG. 12 illustrates sand health update logic for OFF to ON transition. The change in the tractive effort 810, change in creep 812, the current tractive effort value 1106 and the current creep value 1108 are determined as discussed above with regard to FIG. 11. In table 1102, the health value is decremented or incremented based on the determination of the functional effectiveness. The chart 1204 is similar to FIG. 5 above showing graphically the various regions. In this process, three levels are determined and, based on these levels, the health values changed by a certain increment. While the system discloses using discrete increments, a continuous health value change is possible with this system.

In addition to these effects, a single sand nozzle failure can cause a torsional vibration due to an unequal adhesion/friction coefficient between the left and right side wheel rail interface. The axle immediately following the failed sand nozzle typically encounters this phenomenon more than any other axle. Such torsional vibration causes resonance of the wheel/axle set at its natural frequency. This resonance can be detected by observing the frequency content in the torque or speed feedback of that axle and can directly indicate a nozzle health. Any change in resonance torque or speed immediately following a sand command state change is used to determine the health of the sand nozzles in front of the axle.

When introducing elements of the present invention or the embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

TABLE 1

Relationship Between Failure Modes and Nozzles

| Failure | | | Nozzle Affected | | | | | | | |
|---|---|---|---|---|---|---|---|---|---|---|
| Mode # | Device | Condition | 102 | 104 | 106 | 108 | 110 | 112 | 114 | 116 |
| 1 | Front Truck Manual Air Valve | Closed | x | x | x | x | | | | |
| 2 | Rear Truck Manual Air Valve | Closed | | | | | x | x | x | x |
| 3 | Front Truck Forward Sand Solenoid Valve | Failed open or closed | x | x | | | | | | |
| 4 | Front Truck Reverse Sand Solenoid Valve | Failed open or closed | | | x | x | | | | |
| 5 | Rear Truck Reverse | Failed open or | | | | | x | x | | |

TABLE 1-continued

Relationship Between Failure Modes and Nozzles

| Failure Mode # | Device | Condition | Nozzle Affected 102 | 104 | 106 | 108 | 110 | 112 | 114 | 116 |
|---|---|---|---|---|---|---|---|---|---|---|
| | Sand Solenoid Valve | closed | | | | | | | | |
| 6 | Rear Truck Forward Sand Solenoid Valve | Failed open or closed | | | | | | | x | x |
| 7 | Front Truck Sand Box | Failed open or closed | x | x | x | x | | | | |
| 8 | Rear Truck Sand Box | Failed open or closed | | | | | x | x | x | x |
| 9 | Front Truck Forward Right Nozzle | Flow blocked or poor alignment | x | | | | | | | |
| 10 | Front Truck Forward Left Nozzle | Flow blocked or poor alignment | | x | | | | | | |
| 11 | Front Truck Reverse Right Nozzle | Flow blocked or poor alignment | | | x | | | | | |
| 12 | Front Truck Reverse Left Nozzle | Flow blocked or poor alignment | | | | x | | | | |
| 13 | Reverse Truck Forward Right Nozzle | Flow blocked or poor alignment | | | | | x | | | |
| 14 | Reverse Truck Forward Left Nozzle | Flow blocked or poor alignment | | | | | | x | | |
| 15 | Reverse Truck Reverse Right Nozzle | Flow blocked or poor alignment | | | | | | | x | |
| 16 | Reverse Truck Reverse Left Nozzle | Flow blocked or poor alignment | | | | | | | | x |

TABLE 2

Relationship Between Phenomena Detected and Possible Failure Modes

| Phenomina Detected | Direction of Motion | Possible Failure Modes | | |
|---|---|---|---|---|
| Axle 1 friction indicates no sand | fwd | 1 | 3 | 7 |
| Axle 3 friction indicates no sand | rev | 1 | 4 | 7 |
| Axle 4 friction indicates no sand | fwd | 2 | 5 | 8 |
| Axle 6 friction indicates no sand | rev | 2 | 6 | 8 |
| Axle 1 torsional vibration indicates non-symmetrical sand | fwd | 9 | 10 | |
| Axle 3 torsional vibration indicates non-symmetrical sand | rev | 11 | 12 | |
| Axle 4 torsional vibration indicates non-symmetrical sand | fwd | 13 | 14 | |
| Axle 6 torsional vibration indicates non-symmetrical sand | rev | 15 | 16 | |

What is claimed is:

1. A system for assessing a health and functionality of a locomotive friction modifying system wherein the locomotive has a friction modifying applicator associated with a wheel of the locomotive for applying a friction modifying agent to a rail on which the wheel is traversing, the system comprising:

a sensor for detecting a predetermined operational condition of the locomotive;

a controller associated with the sensor and responsive to input from the sensor for determining a per unit creep of an axle of the locomotive, determining a tractive effort of the axle of the locomotive, determining a friction modifying applicator state for the applicator associated with the axle, and comparing the determined per unit creep of the axle, the tractive effort of the axle and the state of the friction modifying applicator associated with the axle to an adhesion characteristic indicative of whether the friction modifying agent is being applied to the rail to provide a desired level of adhesion and providing an indication of whether the locomotive friction modifying system is applying friction modifying agent to the rail as a function of the comparison.

2. The system of claim 1 wherein the friction modifying agent in the friction modifying applicator is one that increases a coefficient of friction at a contact area for enhanced adhesion.

3. The system of claim 1 wherein the friction modifying agent in the friction modifying applicator is one that decreases a coefficient of friction at a contact area for enhanced adhesion.

4. The system of claim 1 wherein the friction modifying agent in the friction modifying applicator is one that removes another friction modifying agent from a contact area.

5. The system of claim 2 wherein the friction modifying agent is one from a group of agents comprising sand, sand-like material, and air.

6. The system of claim 3 wherein the friction modifying agent is one from a group of agents comprising air, steam, water, lubricating fluid, and oil.

7. The system of claim 1 wherein the controller provides the indication of whether the friction modifying agent is being applied to the rail by providing a signal to a locomotive operator, a designated maintainer, remote monitoring equipment, or remote monitoring personnel.

8. The system of claim 1 wherein the controller determines the friction modifying applicator state for the applicator by determining if an applicator control valve is closed or open, or if a flow from an applicator is blocked.

9. The system of claim 1 wherein the adhesion characteristic is further indicative of the health and functionality of the locomotive modifying system, and wherein the controller is unable to determine the health and functionality of the locomotive friction modifying system and provides a signal to that effect.

10. The system of claim 9 wherein the controller utilizes a predetermined length of time during which no change in the health and functionality of the locomotive friction modifying system occurs to provide a signal indicating that the health and functionality of the locomotive friction modifying system is unknown.

11. A method for assessing a health and functionality of a locomotive friction modifying system wherein the locomotive has a friction modifying applicator associated with a wheel supported on an axle of the locomotive for applying a friction modifying agent to a rail on which the wheel is traversing, comprising:

determining per unit creep of an axle of the locomotive;

determining tractive effort of the axle of the locomotive;

determining friction modifying applicator state for the applicator associated with the axle;

comparing the determined per unit creep of the axle, tractive effort of the axle and state of the friction modifying applicator associated with the axle to an adhesion characteristic indicative of whether the friction modifying agent is being applied to the rail to provide a desired level of adhesion and providing an indication of whether the locomotive friction modifying system is applying the friction modifying agent to the rail as a function of the comparison.

12. The method of claim 11 wherein the step of applying at least one friction modifying agent includes applying one that increases a coefficient of friction at a contact area.

13. The method of claim 11 wherein the step of applying at least one friction modifying agent includes applying one that decreases a coefficient of friction at a contact area.

14. The method of claim 11 wherein the step of applying at least one friction modifying agent includes applying one that removes a friction modifying agent from a contact area.

15. The method of claim 12 wherein the step of applying at least one friction modifying agent includes applying at least one selected from a group of agents comprising sand, sand-like material, and air.

16. The method of claim 13 wherein the step of applying at least one friction modifying agent includes applying at least one selected from a group of agents comprising air, steam, water, lubricating fluid, and oil.

17. The method of claim 11 wherein the step of providing an of whether the friction modifying agent is being applied to the rail is done by providing a signal to a locomotive operator, a designated maintainer, remote monitoring equipment, or remote monitoring personnel.

18. The method of claim 11 wherein the step of determining the friction modifying applicator state for the applicator is done by determining if an applicator control valve is closed or open, or if a flow from the applicator is blocked.

19. The method of claim 11 wherein the adhesion characteristic is further indicative of the health and functionality of the locomotive friction modifying system, and wherein health and functionality of the locomotive friction modifying system cannot be determined, further comprising generating a signal to that effect.

20. The method of claim 19 wherein after a predetermined length of time during which no change in the health and functionality of the locomotive friction modifying system has expired, providing a signal indicating that the health and functionality of the locomotive friction modifying system is unknown.

* * * * *